United States Patent [19]

Coolen

[11] Patent Number: 4,512,573

[45] Date of Patent: Apr. 23, 1985

[54] HOCKEY STICK HAVING A U-SHAPED HEAD

[75] Inventor: Toon Coolen, CT Nuenen, Netherlands

[73] Assignee: Grays of Cambridge (Pakistan) Limited, Pakistan

[21] Appl. No.: 466,587

[22] Filed: Feb. 15, 1983

[51] Int. Cl.[3] ..... A63B 59/12

[52] U.S. Cl. ..... 273/67 A; 273/67 D; D21/210

[58] Field of Search ..... 273/67 R, 67 A, 67 D, 273/67 DA, 67 DB, 67 DC, 167 R, 167 D, 167 J, 167 G; D21/210, 211, 214

[56] References Cited

U.S. PATENT DOCUMENTS

D. 244,790 6/1977 Carlson et al. ..... 273/67 A X

FOREIGN PATENT DOCUMENTS 967606 5/1975 Canada ..... 273/67 A
2487208 1/1982 France ..... 273/67 A
935442 8/1963 United Kingdom ..... 273/67 A
972357 10/1964 United Kingdom ..... 273/67 A

*Primary Examiner*—Richard C. Pinkham
*Assistant Examiner*—Matthew L. Schneider
*Attorney, Agent, or Firm*—Kane, Dalsimer, Kane, Sullivan and Kurucz

[57] ABSTRACT

A hockey stick having a head attached to a handle in such a manner that the free end of the head is bent through 180° with regard to the handle. The hockey stick is formed from a plurality of laminations and the head has a portion which is thickened. The distance between the free end of the head and the handle is such that a hockey ball cannot pass through.

6 Claims, 5 Drawing Figures

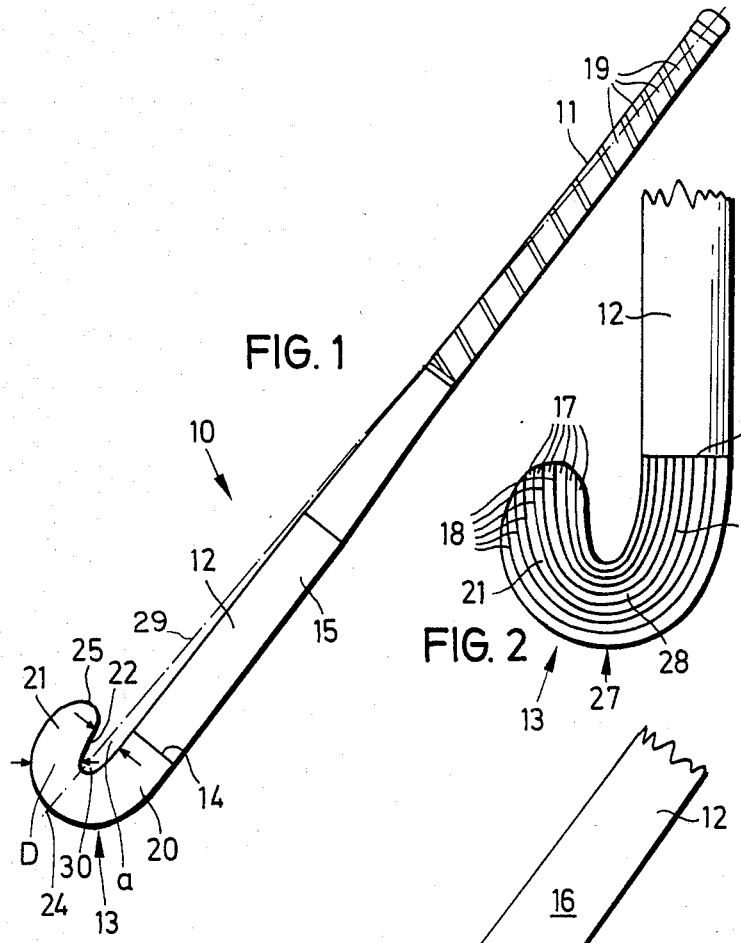
FIG. 1
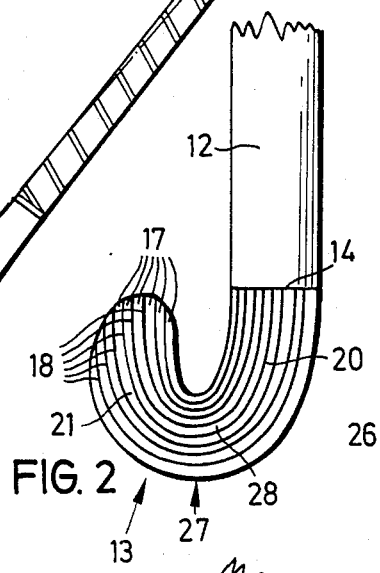
FIG. 2
FIG. 3
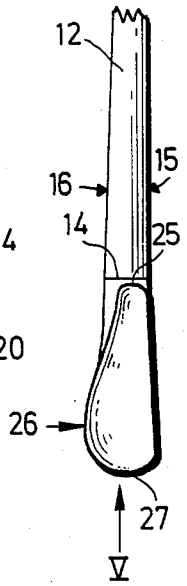
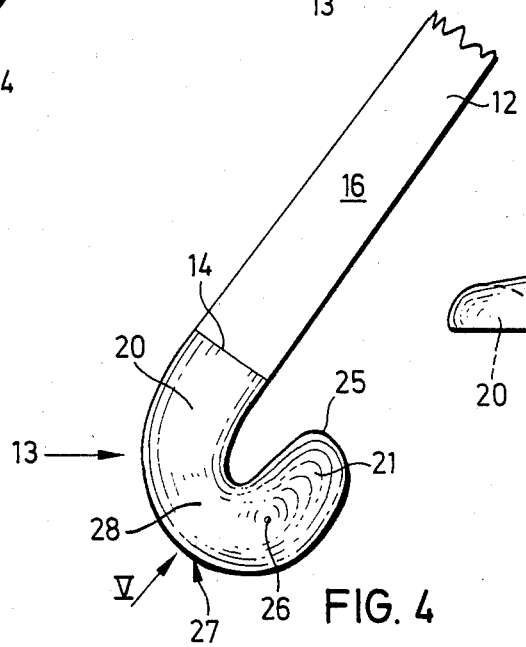
FIG. 4
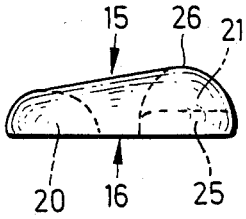
FIG. 5

HOCKEY STICK HAVING A U-SHAPED HEAD

This invention relates to a hockey stick.

In recent times hockey sticks with short heads have been used which are easier to handle than conventional hockey sticks with heads extending a larger distance from the shaft but which only offer the ball a comparatively small attacking surface. During play, therefore, the ball often rolls away over the head or is not hit correctly during the stroke. Particularly during backhand play, the area of the front face of the head facing the ball, when on or close to the ground, is particularly small because the extreme front edge of the end of the head is the closest part of the head to the ground.

It is an object of the present invention to avoid these disadvantages and to provide a hockey stick with a short head, the useful ball-striking surface and ball-stopping surface of which is larger than with conventional hockey sticks and is almost equally large for forehand play and backhand play, and which renders possible rapid play requiring little force.

The present invention provides a hockey stick with a short head, the free end portion of the head being bent in relation to the shank portion of the head merging into the shaft of the stick, wherein the free end portion of the head is bent back through about 180° in such a manner that the inner edge of the free end portion of the head faces the shank portion of the head and is at a short distance from the shank portion of the head.

In the construction according to the present invention, the head is in the shape of a substantially U-shaped hook, the two limbs of which are spaced apart so that the stick passes the ring test and so that, in use, a ball cannot slip through between them. Accordingly, for stopping and striking the ball, the head provides two ball-engaging surfaces, one on the shank of the head and the other on the end portion of the head, those surfaces being disposed side by side with an air space between them.

The construction of the hockey stick according to the present invention also has the advantage that the stock can be turned very quickly and with very little effort, because the outer surface of the base portion of the U-shaped head provides an ideal bearing surface on the ground.

As a result of the enlargement of the playing area of the head achieved by the stick according to the invention, faulty strokes are avoided during the game and many fewer technical faults are made. As a result, play is not interrupted so ofter during matches and playing time is gained.

A particular advantage of the hockey stick according to the invention lies in the fact that balls can be played and hit much more easily backhand over the ground. During the execution of the backhand stroke, the centre of gravity of the head of the stick is close to the centre of gravity of the ball. As a result, only a small torque develops in the stick during striking of the ball whereby more force is transmitted to, and, hence, a higher velocity is imparted to the ball.

With the stick according to the invention, the game of hockey becomes safer. The ball is very unlikely to be struck with the extreme upper edge of the head and no longer jumps up in the event of a somewhat inaccurate stroke. Also during stopping, the ball no longer tends to jump up and, as a result, many injuries are avoided.

Another advantage is that the so-called "high ball" playing technique can be accomplished very easily with the hockey stick according to the invention. This is a technique which only a few hockey players master and involves the ball being "scooped up" and hit over a long distance.

In addition, the hockey stick according to the invention has the advantage of being capable of stopping the ball dead without the ball rolling over the head.

Also when a ball is stopped with the stick in its backhand mode—in which case the stick is laid on the ground (parallel or at a small angle to the ground)—it is more difficult for the ball to slide under the stick. The stick according to the invention is actually closer to the ground because the head does not protrude outwardly as far from the shaft as in conventional sticks. This is an advantage, particularly When playing hockey on artificial grass or indoors.

In order to facilitate handling still further, the head has, at its rounded back, a thickened portion which is provided between the extremity of the free end portion of the head and the apex region of the bend. As a result, the centre of gravity of the hockey stick is displaced (as compared with a conventional stick) so that the stick can be turned with very little effort when changing over from forehand play to backhand play or vice versa. In this case, it is particularly advantageous if the outer marginal boundary of the head is substantially semicircular in form and, preferably, if it extends up to the upper edge extremity of the end portion of the head. As a result, and regardless of how the stick is held during play, the head always rests on the ground through an arcuate marginal portion having a constant radius of curvature. The ball-striking conditions are therefore always the same during forehand play and backhand play.

In order that the head of the stick according to the invention may have adequate strength, despite its markedly bent shape, the head comprises, advantageously, a plurality of curved layers of wood which are glued together and the boundary surfaces of which, which are glued together, extend substantially perpendicularly to the flat front (playing side) of the stick.

A hockey stick constructed in accordance with the invention will now be described, by way of example only, with reference to the accompanying drawing in which:

FIG. 1 is a front view of the hockey stick showing the flat (playing) side of the hockey stick.

FIG. 2 is an enlarged front view of the head of the hockey stick of FIG. 1, FIG. 3 is an end view of the head illustrated in FIG. 2, FIG. 4 is a rear view of the head showing its rounded back, and FIG. 5 is a view of the head as seen in the direction of the arrow V in FIG. 4.

Referring to the accompanying drawings and first of all to FIG. 1, the hockey stick indicated generally by 10 comprises a handle 11, a shaft 12 and a head 13. The head 13 merges into the shaft 12 of the stick at the so-called "joint" or "lower splicing" 14. The side of the hockey stick 10 facing the reader in FIG. 1, is flat and represents the front (playing) face 15 of the hockey stick which, in use, should be used to control the ball, while the opposite side or back 16 of the hockey stick is rounded and should not be used to control the ball during play. The illustrated stick is designed for a right-handed player.

The head 13 consists of a plurality of layers of wood (preferably mulberry) which are glued together, the boundary surfaces 18 of which, which are glued together, extend substantially perpendicularly to the flat front 15 of the hockey stick 10. The layers of wood 17 can be taken further into the shaft 12 of the stick, in which case resilient inserts of glass fibre or other resilient material can be disposed between them. The handle 11 may appropriately carry a wrapping 19 of textile or leather material.

The head 13 consists of a shank portion 20, which merges into the shaft of the stick 12 in the region of the joint 14, and a free end portion 21 which is a continuation of the shank portion 20 and is bent back by about 180° in relation to that portion so that the inner edge 22 of the free end portion 21 faces the shank portion 20 and is at a short distance a from that portion. The distance a is large enough to pass the so-called "ring pass" test, that is to say, a circular ring, which has an internal diameter of 5.08 cm can be placed on one end of the stick, passed over the whole length of the hockey stick 10 including its head 13 and then removed from the other end. The distance a is, however, made as small as possible and on average is equal to about half the largest width D of the head 13.

It can be seen from the drawing that the outer marginal boundary 24 of the head 13 is substantially semicircular in form and extends as far as the upper edge 25 of the end portion 21 of the head.

At its rounded back 16, the head has a thickened portion 26 which is substantially in the region between the upper edge 25 of the end portion 21 of the head and the apex region 27 of the bend 28. As a result of this thickened portion, the centre of gravity of the hockey stick 10 is displaced more towards the end of the head so that in the playing positions illustrated in FIGS. 1 and 4, forehand play (FIG. 1) and backhand play (FIG. 4), it is substantially on a line 29 which passes from the upper end of the handle 11 through the middle of the gap 30 between the shank portion 20 and the end portion 21 of the head. The hockey stick 10 can then be turned particularly easily in the normal playing position so that its handling during play is facilitated.

The hockey stick described and illustrated can be modified in various ways. For example, it is possible to make the distance a between the shank portion 20 and the end portion 21 of the head larger or smaller. The distance should not be so great, however, that a hockey ball can pass through, or become lodged in the gap between the shank portion and end portion of the head. On the other hand, the distance a should not be so small that the ring can no longer be pulled over the head during the ring-pass test. For special purposes, the thickened portion at the back of the hockey stick can also be provided at a somewhat different place to suit individual handling requirements, particularly if the stick is made shorter. It is also possible for the outer marginal boundary 27 of the head to be curved other than arcuately.

It will be evident from the above description with reference to the drawings that the hockey stick has a short head (13), the free end portion (21) of the head being bent in relation to the shank portion (20) of the head merging into the shaft (12) of the stick, wherein the free end portion of the head is bent back through about 180° in such a amanner that the inner edge (22) of the free end portion of the head faces the shank portion of the head and is at a short distance from the shank portion of the head. This construction not only effectively increases the ball-striking and ball-stopping surface area of the stick, that surface area being almost equally large for forehand and backhand play, but also renders possible rapid and safe play with little force.

I claim:

1. A hockey stick having a shaft and a head, the head being provided at one end of the shaft and being in the form of a U-shaped member having two limbs and a base interconnecting the limbs, one limb of the head having a free end portion and the other limb of the head having an end portion forming an axial continuation of the said one end of the shaft, the distance between the said limbs being less than the diameter of a standard size hockey ball and the said limbs and base together providing a ball-striking face.

2. A hockey stick as claimed in claim 1, in which the average value of the said distance is about equal to half the largest width of the said limbs.

3. A hockey stick as claimed in claim 1, in which the said one limb of the head has a thickened portion between its free end portion and a central portion of the base.

4. A hockey stick as claimed in claim 1 in which an outer marginal boundary of the base and said two limbs is substantially semi-circular in form.

5. A hockey stick as claimed in claim 4, in which one extremity of the said semi-circular marginal boundary neighbors the said free end portion of the said one limb of the head.

6. A hockey stick as claimed in claim 1, in which at least the head consists of a plurality of curved layers of wood which are glued together at facing surfaces lying, in the finished stick, perpendicular to the said ball-striking face.

* * * * *